US008333230B2

(12) United States Patent
Marsden et al.

(10) Patent No.: US 8,333,230 B2
(45) Date of Patent: Dec. 18, 2012

(54) CASTING METHODS

(75) Inventors: Kenneth C. Marsden, Idaho Falls, ID (US); Mitchell K. Meyer, Idaho Falls, ID (US); Blair K. Grover, Idaho Falls, ID (US); Randall S. Fielding, Idaho Falls, ID (US); Billy W. Wolfensberger, Rigby, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 913 days.

(21) Appl. No.: 12/175,122

(22) Filed: Jul. 17, 2008

(65) Prior Publication Data

US 2010/0012288 A1 Jan. 21, 2010

(51) Int. Cl.
*B22D 27/15* (2006.01)
*B22D 27/02* (2006.01)
*B22D 18/06* (2006.01)

(52) U.S. Cl. ..... 164/65; 164/129; 164/493; 164/256

(58) Field of Classification Search ..... 164/65, 164/129, 137, 256, 258, 493
See application file for complete search history.

(56) References Cited

U.S. PATENT DOCUMENTS 2,502,595 A * 4/1950 Schermuly et al. ..... 249/119
2,756,138 A * 7/1956 Meister ..... 75/398
2,782,475 A * 2/1957 Wilhelm et al. ..... 164/513
2,894,889 A * 7/1959 Paine, Jr. ..... 376/414
2,952,056 A * 9/1960 Shuck ..... 228/256
2,966,709 A * 1/1961 Winters et al. ..... 164/150.1
3,023,119 A * 2/1962 Anderson et al. ..... 428/330
3,506,235 A * 4/1970 Katz et al. ..... 249/82
3,788,382 A * 1/1974 Daniel et al. ..... 164/151.4
4,762,165 A * 8/1988 Ogino et al. ..... 164/457
5,044,911 A * 9/1991 Seidel et al. ..... 425/110
5,304,701 A 4/1994 Igarashi
5,333,844 A 8/1994 Holcombe et al.
5,358,027 A 10/1994 Calihan et al.
5,626,179 A * 5/1997 Choudhury et al. ..... 164/66.1

(Continued)

FOREIGN PATENT DOCUMENTS

JP 08071726 A * 3/1996
WO WO 2005097377 A1 * 10/2005

OTHER PUBLICATIONS

Wu, Xiaolong, "Design and Analysis for Melt Casting Metallic Fuel Pins Incorporating Volatile Actinides", Aug. 2002.*

(Continued)

*Primary Examiner* — Kevin P Kerns
*Assistant Examiner* — Jacky Yuen
(74) *Attorney, Agent, or Firm* — TraskBritt

(57) ABSTRACT

A casting device includes a covered crucible having a top opening and a bottom orifice, a lid covering the top opening, a stopper rod sealing the bottom orifice, and a reusable mold having at least one chamber, a top end of the chamber being open to and positioned below the bottom orifice and a vacuum tap into the chamber being below the top end of the chamber. A casting method includes charging a crucible with a solid material and covering the crucible, heating the crucible, melting the material, evacuating a chamber of a mold to less than 1 atm absolute through a vacuum tap into the chamber, draining the melted material into the evacuated chamber, solidifying the material in the chamber, and removing the solidified material from the chamber without damaging the chamber.

16 Claims, 4 Drawing Sheets

U.S. PATENT DOCUMENTS

| | | | | |
|---|---|---|---|---|
| 5,819,837 | A * | 10/1998 | Hugo et al. | 164/61 |
| 6,144,690 | A | 11/2000 | Kusamichi et al. | |
| 6,604,941 | B2 | 8/2003 | Billings | |
| 6,819,704 | B2 | 11/2004 | Fishman et al. | |
| 6,993,061 | B2 | 1/2006 | Roach et al. | |
| 7,072,378 | B2 | 7/2006 | Richardson et al. | |
| 7,085,305 | B2 | 8/2006 | Richardson | |

OTHER PUBLICATIONS

Marsden, Ken, "Report on Development of Concepts for the Advanced Casting System in Support of the Deployment of a Remotely Operable Research Scale Fuel Fabrication Facility for Metal Fuel", Mar. 2007, Idaho National Laboratory.*

* cited by examiner 300
218
216
302
100
302
214
150
152
146
158
144
160
142
170
304

CASTING METHODS

CONTRACTUAL ORIGIN OF THE INVENTION

This invention was made with government support under Contract Number DE-AC07-05ID14517 awarded by the United States Department of Energy. The government has certain rights in the invention.

TECHNICAL FIELD

The invention pertains to casting devices and casting methods.

BACKGROUND OF THE INVENTION

The Global Nuclear Energy Partnership (GNEP) program requires spent fuel recycling and re-fabrication technologies with very low losses of actinide materials, low generation of secondary wastes, and remote operability. Traditionally, metal alloy nuclear fuel was cast using counter-gravity pressure-assisted injection. This technology culminated from parallel exploration of a number of fabrication approaches during the 1960s to the 1980s.

Typical operation involved heating the components of a metal alloy using induction coils around a yttria-coated graphite crucible for about 30 to 120 minutes. A vessel surrounding the furnace was evacuated and open bottom tips of tubes formed in about 175 quartz molds were lowered into the melt. The furnace vessel was pressurized by a rapid pulse and the molten fuel alloy was injected vertically upward into the tubes of the quartz molds. The molten fuel alloy rapidly solidified in the molds and the molds were withdrawn from the melt. The quartz molds were removed from the furnace and shattered to release fuel slugs for further fabrication into fuel pins.

The described technology became well-established and recognized as highly reliable and adaptable to remote operation. The process was used for remote fabrication of about 30,000 irradiated metal fuel pins and many more unirradiated (cold) pins of fuel alloys. In the 1990s, Japan adopted the same technology approach and continues its utilization for fabrication of metal fuel to support metal fuel research and development efforts.

Unfortunately, the described technology produces a significant high-level radiation waste stream from the shattered molds. Also, the crucible technology dates back to the 1940s and involves manual recoating and cleaning, which leads to metal fuel material losses in the removed coating dross. The recoating and cleaning is labor intensive and its effectiveness is operator dependent. Further, about 30% of the melt remains in the crucible as a heel that is recycled. Such extensive recycling limits process efficiency and generates a source of impurity buildup.

While the invention was motivated in addressing the above-identified issues, it is not so limited. The invention is only limited by the accompanying claims as literally worded, without interpretative or other limiting reference to the specification, and in accordance with the doctrine of equivalents.

BRIEF DESCRIPTION OF THE DRAWINGS

Preferred embodiments of the invention are described below with reference to the following accompanying drawings.

DETAILED DESCRIPTION OF THE INVENTION

Figure 1:
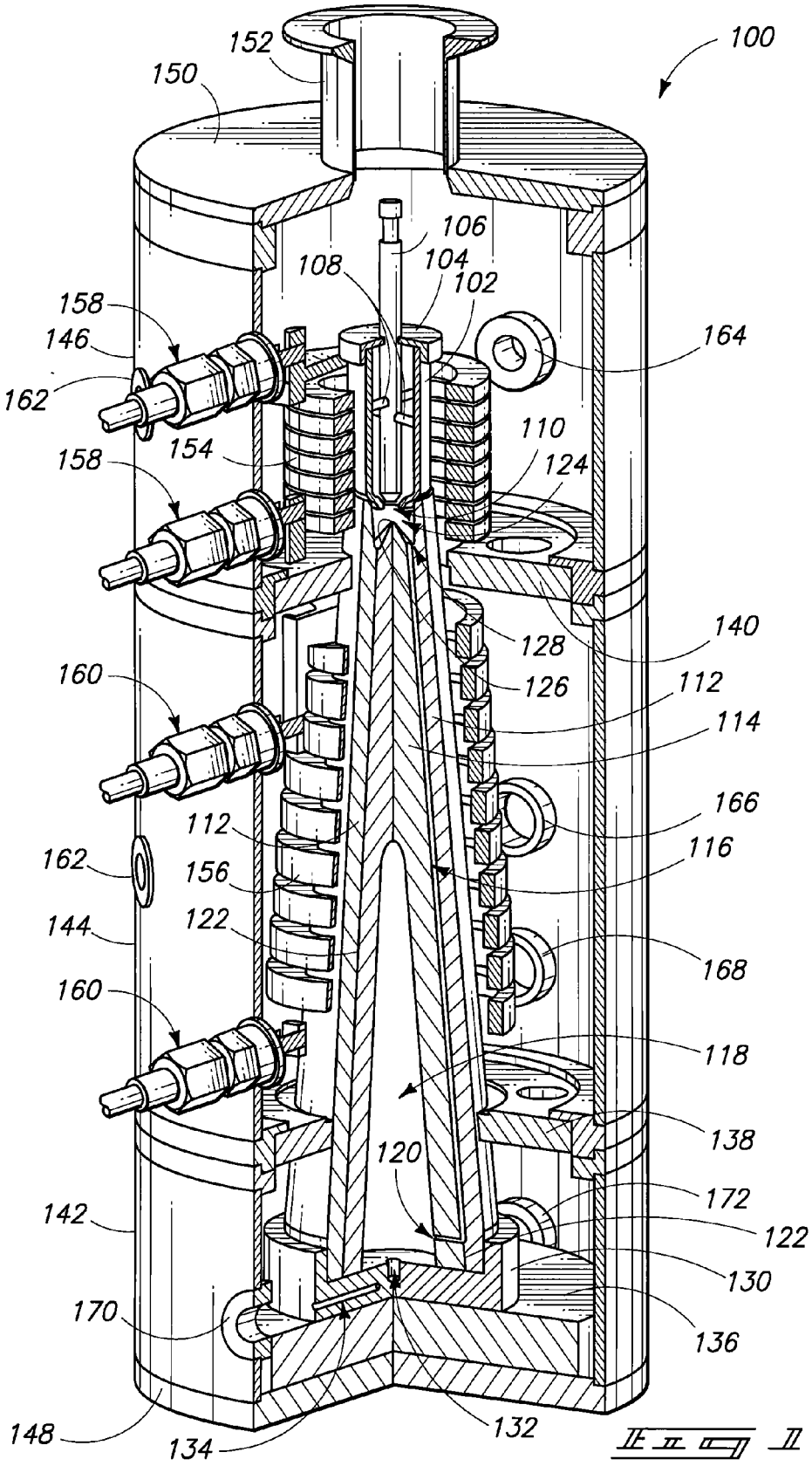
FIG. 1 is a cut-away perspective view of selected elements of a bench-scale casting system according to one aspect of the invention.

In addition to generating high-level radiation waste, losing fuel material in coating dross, and leaving a crucible heel, counter-gravity pressure-assisted injection casting has been found to lead to losses of volatile elements, such as the minor actinide, americium. Since the crucible is uncovered in a vacuum environment, some elements easily volatilize.

As may be appreciated from the discussion herein, various aspects of the invention may improve on counter-gravity pressure-assisted injection casting in one or more ways. Specifically, the devices and/or methods may reduce losses of volatile elements, such as americium, at least by using a covered crucible and/or pressurizing with a heavy, large atom/molecule cover gas. The devices and/or methods may reduce generation of high-level radiation waste at least by providing a reusable mold. The devices and/or methods may reduce equipment maintenance and loss of fuel material in coating dross at least by using advanced crucible materials and coatings. The devices and/or methods may reduce a crucible heel at least by using bottom-pouring technology, optionally including differential pressure casting. Other aspects of the invention may assist in obtaining the described benefits or other benefits, such as facilitating remote control of the devices and/or methods and facilitating use of a recycled nuclear fuel feedstock.

According to one aspect of the invention, a casting device includes a covered crucible having a top opening and a bottom orifice and a reusable mold having at least one chamber. A lid covers the top opening and a stopper rod seals the bottom orifice. A top end of the chamber is open to and positioned below the bottom orifice and a vacuum tap into the chamber is below the top end of the chamber. The casting device includes a first heating mechanism around the crucible and a second heating mechanism around the mold, the first and second heating mechanism being configured for control independent of each other. A first temperature probe is operatively associated with the crucible and a second temperature probe is operatively associated with the mold.

By way of example, the casting device may further include a sealed vessel surrounding the crucible, the first and second heating mechanisms, the first and second temperature probes, and the mold. A sealed vessel allows for secondary containment of elements that volatilize during melting of material in the crucible, elements that might spill during pouring or other operations, etc. The sealed vessel also allows for evacuation of the atmosphere around the crucible and mold and pressurizing with an inert gas during pouring operations to reduce contamination of the melted material, among other benefits. For example, the sealed vessel further provides covering of the heating mechanisms to avoid short-circuiting or electrocution hazards during operation.

The lid covering the crucible does not necessarily mean that the lid is in sealed engagement with the crucible, although it may be if desired. Not requiring sealed engagement of the lid with the crucible may simplify manipulation of the casting device during remote operations. From the discussion of casting methods herein, it will be appreciated that evacuation and pressurization of the crucible may be achieved with the crucible covered, but not sealed. Thus, evacuation or pressurization of the environment surrounding the crucible may also evacuate or pressurize the covered crucible. The lid may help contain splattering during melting of material in the crucible.

Although not shown, a fitting may be provided through the lid for a gas line to pressurize the crucible to a pressure above that of the surrounding environment. Even though the pressurization may be transitory in the case where the crucible is covered, but not sealed, such transitory pressurization may still be advantageous in practicing the casting methods herein.

The stopper rod may be in sealed engagement with an inside surface of the crucible such that raising the stopper rod unseals the bottom orifice. With the stopper rod in sealed engagement with the inside surface of the crucible, the stopper rod may be removed through the top opening of the covered crucible and easily replaced, such as by remote operations, if desired. If a stopper rod is in sealed engagement with an outside surface of the crucible (such as the bottom), replacement might be more complex. Either way, bottom pouring may allow complete or substantially complete draining of the crucible. "Substantially complete" draining refers to the circumstance where some amount of melted material residue remains in the crucible after draining, but is insubstantial enough not to produce impurity accumulation problems.

The first heating mechanism may include first induction coils and the second heating mechanism may include separate second induction coils. Use of induction coils allows fast heating rates to reduce process time and secondary reactions that may occur while waiting for process temperatures to be reached. Independent control of the second heating mechanism with respect to the first heating mechanism (by way of the first and second temperature probes) may accommodate process optimization by largely decoupling crucible temperature and mold temperature. Consequently, a mold temperature may be selected to facilitate both adequate filling of the chamber as well as quick solidification within the chamber.

That is, a mold that is too hot might leak melted material from the chamber due to slow solidification, while a mold that is too cold might not allow adequate filling of the chamber due to overly quick solidification of the melted material. The separate coils enable separate considerations in melting materials in the crucible and in solidifying materials in the mold. Thermocouples constitute one example of suitable temperature probes, though other known devices may also be suitable depending on process conditions and operating environment.

The casting device may be designed so that it may operate without any active cooling equipment, for example, water cooling or forced-air cooling. Independent control of the heating mechanisms may facilitate such a design. Water-cooled induction coils and vessels are typical in industrial casting. The lack of active cooling equipment, but especially the lack of water cooling, may improve the ease of remote operation and decrease safety concerns. For example, remote operation might be complicated by additional requirements of monitoring and controlling water or other liquid flows. Also, with no water actively involved in operating the casting device, the risk of a steam explosion is significantly reduced. In the case of casting recycled nuclear fuel, the absence of water cooling may improve criticality safety. That is, for material containing very high fissile content, such as fast reactor fuels, water could potentially function as a neutron moderator, reducing neutron velocity and increasing the risk of a chain reaction.

The casting device may further include a sealed reservoir extending from the bottom orifice to the top end of the chamber. As one possibility, the mold may include an inner cone and a separable, complementary outer cup, the inner cone contacting the outer cup. For such a configuration, a top of the inner cone along with a top of the outer cup may form at least a part of the sealed reservoir extending from the bottom orifice to the top end of the chamber. In the event that the reusable mold is evacuated, the sealed reservoir extending from the bottom orifice to the top end of the chamber may maintain the vacuum within the chamber regardless of pressures external to the mold. Additionally, the sealed reservoir may reduce spillage of melted material forced from the covered crucible, especially in the event that the crucible is pressurized.

The chamber in the cup-and-cone mold may be defined partially by a wall of the outer cup and partially by a wall of the inner cone. It will be appreciated that the inner cone may be separated from the outer cup leaving behind solidified material cast in the chamber and easily removable from the split apart mold.

Improvement in process efficiency may be facilitated when the mold includes a plurality of chambers symmetrically distributed around a central axis of the mold. Not only do an increased number of chambers improve process efficiency, but symmetrical distribution of chambers around a central axis may enable a temperature profile through the mold such that individual chambers exhibit the same or substantially the same wall temperatures. Also, symmetric distribution of chambers may provide for equal distribution of melted material through the top ends of such chambers. With similar wall temperatures and equal melt distribution, less waste resulting from inconsistent casting results among the chambers might be expected.

An alternative mold shape includes a "split block" also with a plurality of chambers, but instead evenly distributed along the block length with a manifold distributing melted material among the chambers. Understandably, given heat loss differentials from the center of the block compared to from the edges, inconsistent casting may result from different chamber wall temperatures. Also, a distribution manifold may be less effective and produce inconsistent casting among the chambers.

The chamber may include a cylindrical shape. High aspect ratio (length/diameter) shapes may enable formation of fuel slugs used in production of nuclear fuel pins. Consequently, the cylindrical shape may exhibit an aspect ratio of at least about 30. Experience indicates that high aspect ratio shapes may be challenging to form consistently, however, aspects of the invention described herein may overcome challenges of high aspect ratio casting. Fuel pins with dimensions of 18 inches×0.5 inch exhibit an aspect ratio of 36 and may benefit from production according to aspects of the invention. Fuel pins with dimensions of 18 inches×0.125 inch exhibit an aspect ratio of 144 and may significantly benefit. The higher the aspect ratio, the more significant the improvements described herein become.

Generally, the specific materials of which the mold, crucible, and their coatings are composed may depend on the composition of the specific material being cast. Interior surfaces of the crucible and the chamber may be coated with a material selected from the group consisting of hafnium nitride, hafnium oxynitride, titanium nitride, zirconium nitride, yttria, tungsten, graphite, and combinations thereof. Crucibles may be formed from transition metals or alloys of thereof, most commonly, niobium. A hafnium nitride coating on a niobium substrate may be suitable. Studies may be undertaken to test for melt/material interactions with the goal of identifying molds, crucibles, and coating combinations that reduce equipment maintenance, such as periodic recoating, and material loss. Some indication exists that fuel alloys containing 20-30% zirconium may tend to be more reactive with some coatings, such as hafnium nitride, partially due to the higher melting temperature of zirconium. In such case, hafnium oxynitride combined with a niobium substrate may be better.

Instead of or in addition to coating the mold, a sheath may be provided to encase part of the solidified material. The sheath may begin as a thin-walled tube placed inside a mold chamber so that the melted material pours into and solidifies inside the tube. With open ends, the sheath may be evacuated and filled with melted material. After solidification of the material within, the sheath may be removed along with it. For the case of casting fuel pins, the sheath may become a permanent outer covering of the fuel pin. Zirconium represents one useful sheath material for casting fuel pins. Conceivably, it might be possible for the sheath to be removed after casting, if desired, in some circumstances.

Casting in a sheath represents a significant alternative for alloys cast at very high temperatures. As indicated above, high-temperature casting may encourage chemical interaction of the melted material with mold coatings or the mold itself. Observation indicates that attempts to cast melted material into freely-suspended sheaths can result in significant warping of the sheaths. Positioning a sheath inside a mold chamber, where the outer diameter of the sheath conforms to the inner diameter of the chamber, may hold the sheath straight for successful full-length casting.

Wall thickness of a sheath may depend largely on the desired wall thickness in a product incorporating the sheath. Other considerations may include durability during handling and casting, how the material selected for the sheath might perform during casting in contact with a particular melted material, etc. Typically, a sheath wall may be just thick enough to avoid damage prior to insertion into the mold. In that sense, a sheath may essentially constitute a removable mold "coating."

According to another aspect of the invention, a casting device includes a covered crucible having a top opening and a bottom orifice and a reusable mold having at least one chamber. A lid covers the top opening and a stopper rod seals the bottom orifice. A top end of the chamber is open to and positioned below the bottom orifice and a vacuum tap into the chamber is below the top end of the chamber. The mold includes an inner cone and a separable, complementary outer cup, the inner cone contacting the outer cup. A top of the inner cone along with a top of the outer cup form at least a part of a sealed reservoir extending from the bottom orifice to the top end of the chamber. The chamber is defined partially by a wall of the outer cup and partially by a wall of the inner cone. The chamber includes a cylindrical shape that exhibits an aspect ratio of at least about 30.

By way of example, the device may further include a sealed vessel surrounding the crucible and the mold. The stopper rod may be in sealed engagement with an inside surface of the crucible such that raising the stopper rod unseals the bottom orifice. The mold may include at least three identical chambers symmetrically distributed around a central axis of the inner cone. The at least three identical chambers may be at least 60 identical chambers. Composition of the crucible, the mold, and their coatings may be as described above. The device may further include first induction heating coils around the crucible and separate second induction heating coils around the mold, the first and second heating coils being configured for control independent of each other.

Figure 2:
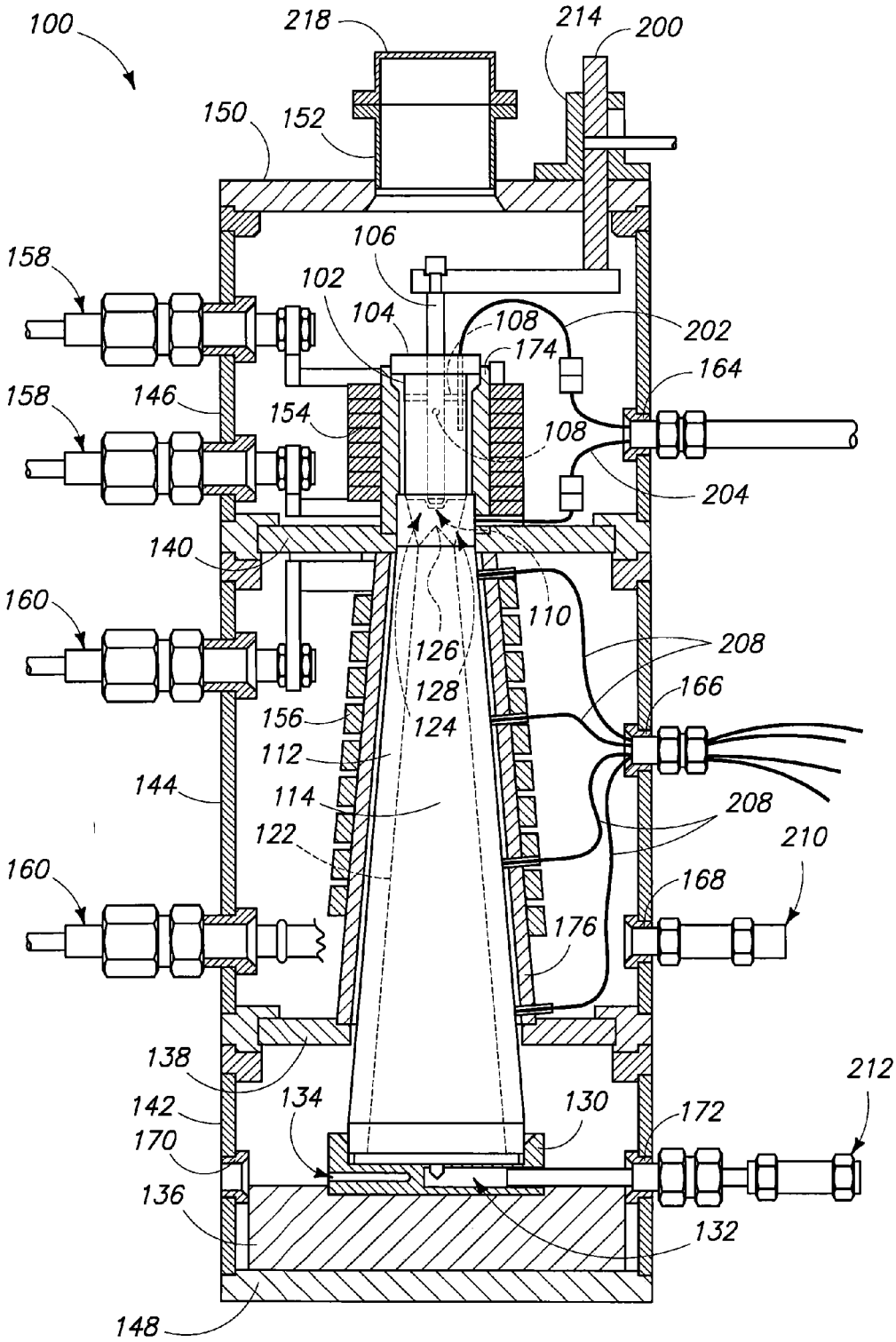
FIG. 2 is a partial cross-sectional view of the casting device of FIG. 1 showing some elements added or removed in comparison to FIGS. 1 and 3 for simplicity.
Figure 3:
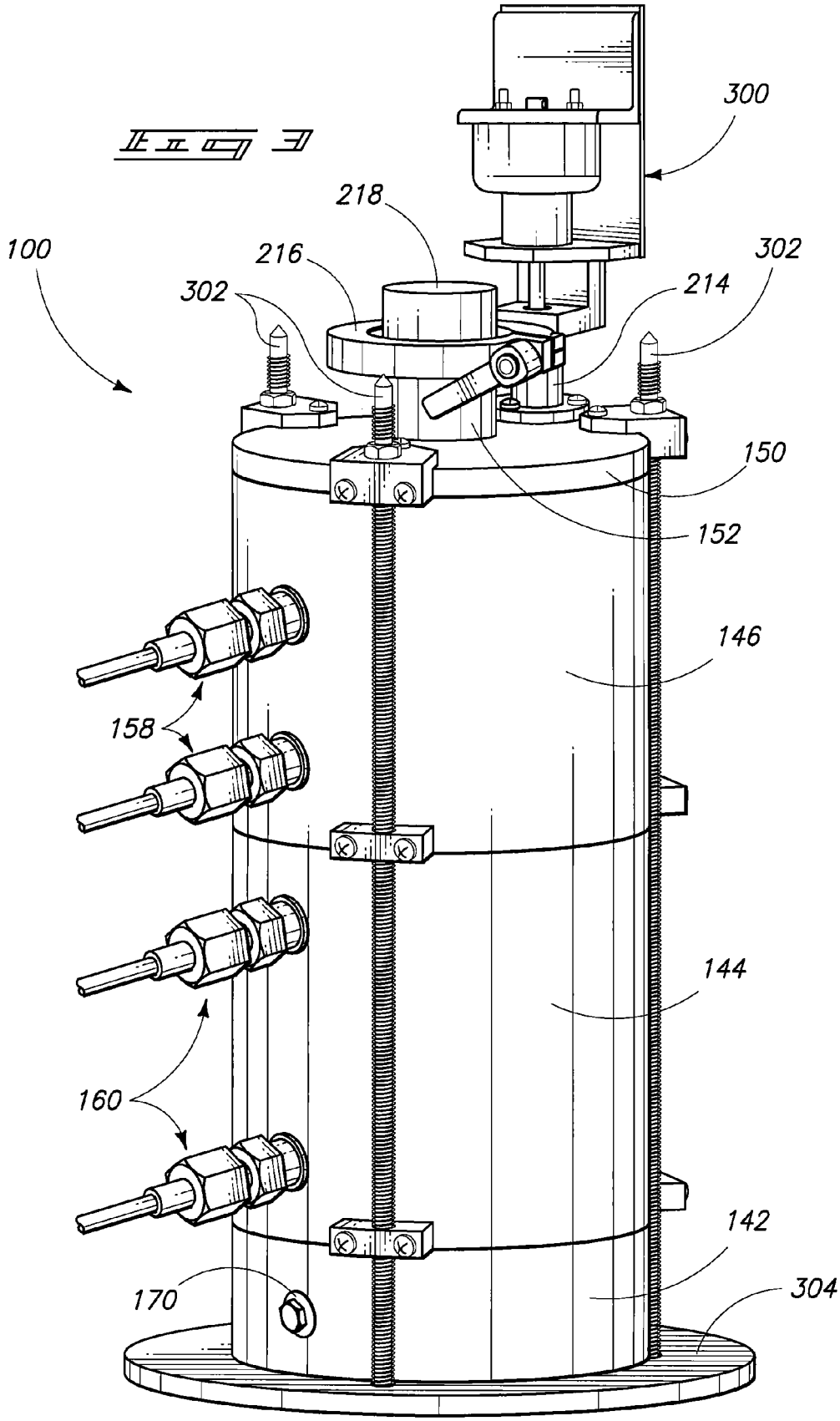
FIG. 3 is a perspective view of the casting device of FIG. 1 showing some elements added or removed in comparison to FIGS. 1 and 2 for simplicity.

FIGS. 1-3 show selected elements of a bench-scale casting system. It will be appreciated that aspects of the invention described herein may be embodied in a variety of designs for a variety of applications. A casting device 100 shown in FIGS. 1-3 represents one design intended for laboratory testing related to casting recycled nuclear fuel alloys. As may be appreciated from comparison to selected elements of an engineering-scale casting system shown in FIG. 4, scaling of casting device 100 may yield a somewhat different configuration, but nonetheless embody various aspects of the invention. As a result, a full-scale casting device embodying aspects of the invention may appear somewhat different from the devices shown in FIGS. 1-4. Understandably, while configured for casting recycled nuclear fuel alloys, benefits and advantages associated with aspects of the invention may be useful in other contexts.

Casting device 100 includes a crucible 102 covered with a lid 104. A stopper rod 106 is in sealed engagement with an inside surface of crucible 102 to seal a bottom orifice 110. Stopper rod 106 includes two pins 108 in orthogonal orientation. The orthogonal pins 108 may hold stopper rod 106 in position during placement of lid 104 by offering support of stopper rod 106 against inner walls of crucible 102. Crucible 102 is in sealed engagement with an outer cup 112 of a reusable mold. The reusable mold includes outer cup 112 and an inner cone 114 contacting the outer cup at an interface 122. Outer cup 112 does not contact inner cone 114 in a chamber 116. Consequently, chamber 116 is defined partially by a wall of outer cup 112 and partially by a wall of inner cone 114, as shown in FIGS. 1 and 2.

It is apparent from FIG. 1 that a sealed reservoir 124 is formed at the top of inner cone 114 and outer cup 112. Reservoir 124 includes a peak 126 of inner cone 114 surrounded by an annular valley 128 proximate interface 122. Consequently, when stopper rod 106 lifts to drain a melted material from crucible 102, the material flows over peak 126 and distributes into valley 128.

Although not shown in FIGS. 1-3, casting device 100 includes two more chambers identical to chamber 116, the three chambers being symmetrically distributed about a central axis of inner cone 114. Since each of the three chambers are open to and positioned below bottom orifice 110 in the manner shown at the bottom of valley 128, drained material may be distributed among the chambers through reservoir 124.

Outer cup 112 and inner cone 114 are seated in a base 130 including a vacuum port 132. Tapered inner walls of base 130 allow for easier alignment of the mold with base 130 during remote operations. A void 118 within inner cone 114 and aligned with vacuum port 132 allows evacuation of void 118. A vacuum tap 120 extends from void 118 through inner cone 114 to chamber 116, allowing evacuation of chamber 116 and reservoir 124. As a result, outer cup 112 may be in sealed engagement with base 130 to avoid leaking after evacuation. Sealing mechanisms may be selected from among those that allow relatively easy separation of outer cup 112 from base 130 to facilitate remote operations. Vacuum tap 120 may additionally function as an orifice with a smaller diameter than chamber 116 to reduce leakage of melted material into void 118. If vacuum tap 120 diameter is smaller than chamber 116 diameter, then a comparatively smaller amount of material solidification may block flow.

Base 130 also includes a probe inlet 134 for insertion of a temperature probe to monitor temperature at the bottom of the mold. A crucible coil 154 is positioned around crucible 102 and a mold coil 156 is positioned around outer cup 112. Crucible coil connectors 158 and mold coil connectors 160 allow application of power for induction heating. Crucible coil 154 and mold coil 156 may be held in place by posts or brackets (not shown).

Crucible insulation 174 between crucible coil 154 and crucible 102 and mold insulation 176 between mold coil 156 and outer cup 112 are shown only in FIG. 2 to simplify FIGS. 1 and 3. Crucible insulation 174 and mold insulation 176 may include a material suitable for thermal insulation, electrical insulation, or both. A porous ceramic fiber insulation may be suitable to allow thermal insulation as well as electrical insulation, preventing shorting between crucible coil 154 and crucible 102 and between mold coil 156 and outer cup 112.

A thermocouple 202 shown in FIG. 2 along with a thermocouple 204 may be inserted through a port 164 to measure temperature, respectively, inside crucible 102 and at the top of outer cup 112. Additional thermocouples 208 may be inserted through a port 166 to measure temperature at various elevations of outer cup 112.

FIGS. 1-3 also show a vessel that may be sealed and that includes a cap 148, a lower section 142, a middle section 144, an upper section 146, and a lid 150. The sections and lids are stacked with appropriate sealing mechanisms between them and compressed together using tie rods 302 (shown in FIG. 3). The assembled vessel rests on a stabilizing platform 304 to which tie rods 302 are connected. Casting device 100 thus includes a sealed vessel surrounding crucible 102, crucible coil 154, mold coil 156, thermocouples 202, 204, and 208, outer cup 112, and inner cone 114.

Since casting device 100 is part of a bench-scale casting system, it has a relatively narrow diameter to allow entry through a port of a glove box. As a result, the relatively close proximity of crucible coil 154 and mold coil 156 to middle section 144 and upper section 146 of the sealed vessel may produce parasitic losses from induction heating. The sealed vessel may be formed from a highly conductive material, such as copper, to reduce parasitic losses. Additionally, copper conducts heat well and may assist in dissipating heat and solidifying melted material quickly in the event of a spill.

A variety of ports, such as port 164 and port 166 may be provided through the vessel and sealing arrangements made in the ports while allowing access to components inside the vessel. For example, a port 168 provides access to a vessel vacuum line 210 connected to a vacuum device (not shown) and a port 172 provides access to a mold vacuum line 212 connected to the same or a different vacuum device (not shown). A port 170 may provide access to probe inlet 134, although FIG. 3 shows port 170 sealed shut. Ports 162 and other ports (not shown) are additionally provided for other access purposes. For example, one port provides access to a vessel pressure line connected to a gas source and another port provides access to a crucible pressure line connected to the same or a different gas source.

A lower platform 136, on which base 130 rests, in turn rests on cap 148. A middle platform 138 secured to middle section 144 and an upper platform 140 secured to upper section 146 segregate the space within the vessel and provide support for components therein. For example, posts (not shown) for holding crucible coil 154 and mold coil 156 in place may rest on upper platform 140 and middle platform 138, respectively. The platforms may be fabricated of ceramic fiber board and include openings to allow gas passage throughout the vessel.

A top port 152 provides access through lid 150 chiefly to crucible 102, for example, for charging with material to be melted. Additionally, a top lid 218 attached to top port 152 with a pipe clamp 216 may be part of some sort of mechanism (not shown) for a biasing stopper rod 106 against the inside surface of crucible 102. As one example, top lid 218 may provide a seat for a spring-loaded extension rod that projects downward from top lid 218 and contacts the top of stopper rod 106. With the spring seated in top lid 218, the extension rod may apply a downward force to stopper rod 106, biasing it against the inside surface of crucible 102 to more effectively close orifice 110. A lifter mechanism 300 is provided to elevate a lifter arm assembly 200 extending through a sleeve 214 to open orifice 110. If a biasing mechanism is provided, then lifter mechanism 300 may overcome the bias against stopper rod 106.

Figure 4:
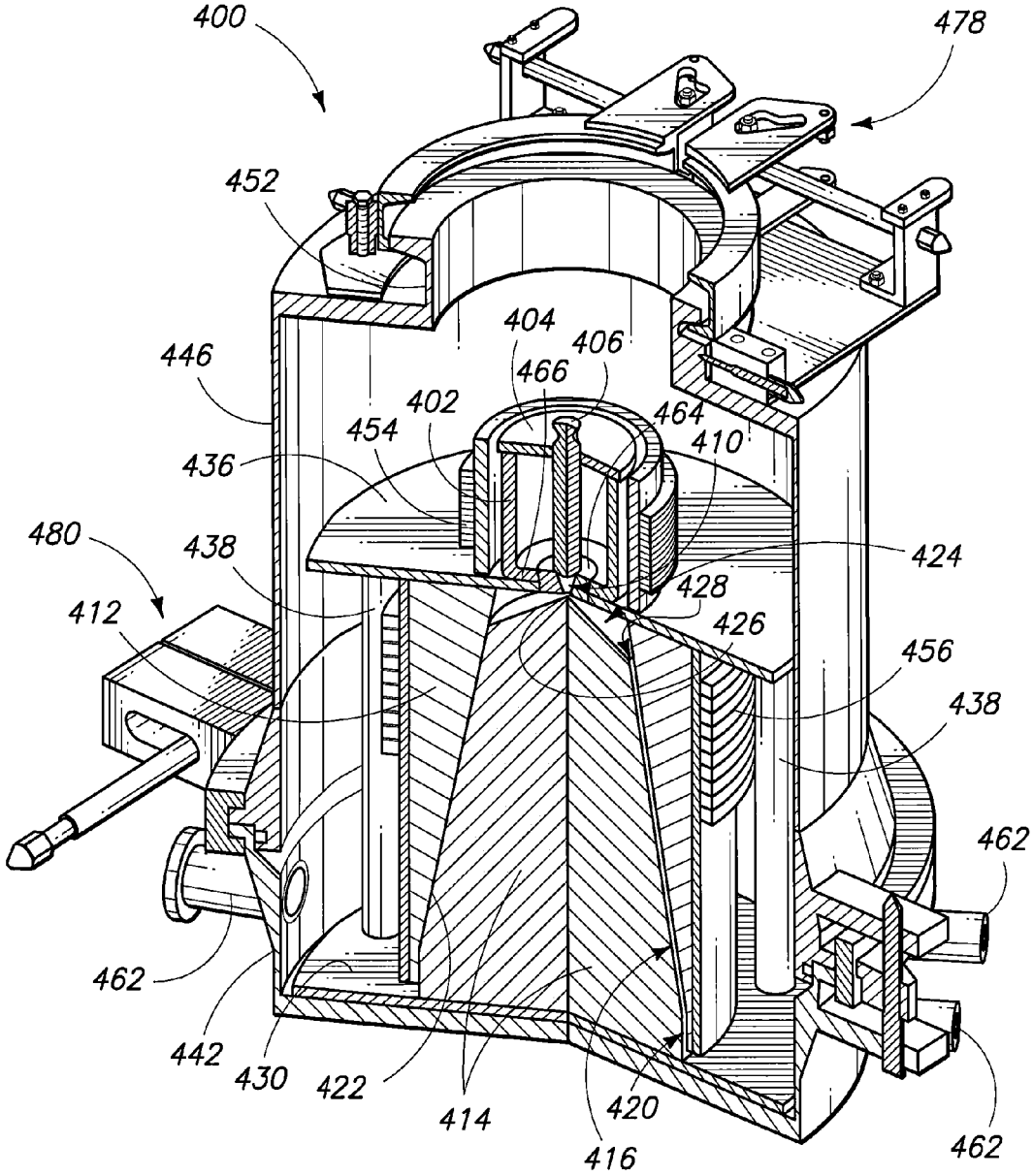
FIG. 4 is a cut-away perspective view of selected elements of an engineering-scale casting system according to another aspect of the invention.

A casting device 400 of FIG. 4 showing selected elements of an engineering-scale casting system includes several similarities to casting device 100, but also a few differences primarily associated with improving remote operation of the device. Casting device 400 includes a crucible 402 covered with a lid 404. A stopper rod 406 is in sealed engagement with an inside surface of crucible 402 to seal a bottom orifice 410. Crucible 402 is in sealed engagement with a platform 436 which is, in turn, in sealed engagement with a top of an outer cup 412 of a reusable mold. The reusable mold includes outer cup 412 and an inner cone 414 contacting the outer cup at an interface 422. Outer cup 412 does not contact inner cone 414 in a chamber 416. Consequently, chamber 416 is defined partially by a wall of outer cup 412 and partially by a wall of inner cone 414, as shown in FIG. 4.

It is apparent from FIG. 4 that a sealed reservoir 424 is formed at the top of inner cone 414 and outer cup 412. Reservoir 424 includes a peak 426 of inner cone 414 surrounded by an annular valley 428 proximate interface 422. Consequently, when stopper rod 406 lifts to drain a melted material from crucible 402, the material flows over peak 426 and distributes into valley 428.

Although not shown in FIG. 4, casting device 400 includes 59 more chambers identical to chamber 416, the 60 chambers being symmetrically distributed about a central axis of inner cone 414. Since each of the 60 chambers are open to and positioned below orifice 410 in the manner shown at the bottom of valley 428, drained material may be distributed among the chambers through reservoir 424.

Outer cup 412 and inner cone 414 rest on a base 430. A vacuum tap 420 extends along interface 422 toward base 430, allowing evacuation of chamber 416 and reservoir 424. Base 430 may essentially be a "freeze plate" formed from a material that conducts heat well, such as copper, to assist in dissipating heat and solidifying melted material quickly in the event of a spill. Various ports 462 are provided, for example, to allow evacuation of the atmosphere surrounding the mold, thus evacuating through vacuum tap 420 as well. As an alternative to the configuration of vacuum tap 420, inner cone 414 may instead include a central void, such as void 118 of inner cone 114, and base 430 may be modified and its thickness increased to include a vacuum port, such as vacuum port 132 of base 130, to evacuate the central void. An alternative vacuum port may then be provided from the central void to chamber 416. A crucible coil 454 is positioned around crucible 402 and a mold coil 456 is positioned around outer cup 412. Coil connectors, thermocouples, vacuum lines, pressure lines, etc. analogous to those discussed with regard to FIGS. 1 through 3 may be provided.

FIG. 4 also shows a vessel that may be sealed and that includes a lower section 442 and an upper section 446 with appropriate sealing mechanisms between them and secured with a pipe clamp 480. Pipe clamp 480 is a known, remotely operable pipe clamp, though other varieties of pipe clamps may be used. Casting device 400 thus includes a sealed vessel surrounding crucible 402, crucible coil 454, mold coil 456, outer cup 412, and inner cone 414. A variety of ports 462 may be provided through the vessel and sealing arrangements made in the ports while allowing access to components inside the vessel. Ports 462 are shown extending through lower section 442, allowing removal of upper section 446 without disconnecting apparatuses accessing the vessel through ports 462. Apparatuses may be connected to ports 462 using known remotely operable connectors.

Platform 436, on which crucible 402 rests, is supported by columns 438 extending to base 430. Platform 436 also segregates the space within the vessel and provides support for components therein. A sleeve 464 of crucible 402 includes orifice 410 sealed by stopper rod 406 at the bottom of crucible 402. Sleeve 464 extends beyond a bottom wall 466 of crucible 402 surrounding sleeve 464 and passes through platform 436. Sleeve 464 may be replaced due to erosion of orifice 410 or to change otherwise the flow characteristics of orifice 410 without replacing crucible 402. Such flexibility may reduce maintenance efforts. Stopper rod 406 may be replaced to match changes in orifice 410. Changes in orifice 410 and/or stopper rod 406 may be used to increase or decrease flow rate out of orifice 410. Sleeve 464 may be fabricated from a material different than the main body of crucible 402 to obtain operational performance that the material comprised by the main body of crucible 402 does not provide.

A top port 452 provides access through upper section 446 chiefly to crucible 402, for example, for charging with material to be melted. Additionally, a top lid (not shown) may be provided analogous to top lid 218 discussed above with regard to FIGS. 1 through 3 and may be secured with a pipe clamp 478. Pipe clamp 478 is a known, remotely operable pipe clamp, though other varieties of pipe clamps may be used. Biasing mechanisms for stopper rod 406 such as discussed above for stopper rod 106 may also be provided.

According to a further aspect of the invention, a casting a method includes charging a crucible with a solid material and covering the crucible, the material exhibiting a minimum temperature of melting, and heating a reusable mold to greater than 100° C. but less than the minimum temperature. The method includes heating the crucible to greater than the minimum temperature and melting the material. A chamber of the mold is evacuated to less than 1 atmosphere (atm) absolute through a vacuum tap into the chamber, a top end of the chamber being open to and positioned below a closed bottom orifice of the crucible and the vacuum tap being below the top end of the chamber. The method further includes opening the bottom orifice of the covered crucible, draining the melted material through the top end into the evacuated chamber, solidifying the material in the chamber, and removing the solidified material from the chamber without damaging the chamber.

By way of example, the method may further include evacuating the crucible to a vacuum less than 1 atm absolute and pressurizing the evacuated crucible with an inert gas to a pressure greater than the vacuum. The evacuation/pressurization may be repeated, for example, three times, to purge the crucible upon initial startup or after opening the crucible to recharge it. If the method is performed in an isolated chamber with an inert environment, such as a hot cell, then purging after recharging may offer little advantage.

The inert gas may be argon. Argon represents one example of a heavy, large-atom/molecule cover gas. In diffusion studies of volatile components, theoretical calculations indicated that using a heavy, large-atom/molecule cover gas may assist in decreasing a diffusion coefficient of volatile actinides, such as americium. Decreasing a diffusion coefficient may decrease the molar flux of the volatile component from the melt. On a related note, increasing cover gas pressure additionally assists with draining the crucible through the orifice.

The method may further include evacuating a sealed vessel surrounding the crucible and the mold to a vacuum less than 1 atm absolute and pressurizing the sealed vessel with an inert gas to a pressure greater than the vacuum. If the pressure reached after pressurization is limited to less than 1 atm gauge, then the sealed vessel need not be a coded pressure vessel of suitable design for operating pressures greater than 1 atm gauge. The complexities of designing and operating a coded pressure vessel likely offer little advantage toward achieving the benefits described herein. As discussed below, relatively small pressure differentials may be suitable.

The sealed vessel may be located in an isolated chamber and the method may be performed using manipulations remotely controlled from outside the chamber. For example, the solidified material may include a recycled nuclear fuel alloy. The isolated chamber may shield operators from radioactivity from the alloy. Even when the sealed vessel is within an isolated chamber, containment provided by the sealed vessel and described above may be especially significant for using radioactive materials.

The heating of the crucible may include using an induction heating coil and the method may further include generating electromagnetic stirring forces in the crucible using the induction coil. A difference of at least 1 atm may exist between the covered crucible and the evacuated chamber. Often the difference may range between 1 to 2 atm and is unlikely to exceed 4 atm. Pressurization of the covered crucible limited to less than 1 atm gauge and evacuation of the mold to a vacuum less than 1 atm absolute may yield a difference of 1 to 2 atm, although the difference may be less than 1 atm. Consequently, the differential pressure may assist, along with gravity, in the bottom-pour casting. A more significant difference in pressure, and thus better pour efficiency, may be obtained using a covered crucible and an evacuated chamber compared to an open crucible and an evacuated chamber. The covered crucible further reduces loss of volatile elements.

Generally, the material will be completely melted, though methodologies are conceivable that might not completely melt the material. Of course, incomplete melting may leave a residue in the crucible that does not drain. The draining of the melted material may include draining substantially all of the melted material from the crucible, achieving a significant advancement over counter-gravity pressure-assisted injection casting, which leaves a heel in the crucible.

In the case where the covered crucible is not sealed, the evacuation and pressurization of the sealed vessel may accomplish the evacuation and pressurization of the covered crucible. Essentially, this could occur by way of small inward leaks from the sealed vessel into the covered crucible. Alternatively, the crucible may be evacuated and pressurized independently, for example, using additional fittings through the lid as explained above. Especially after the chamber is evacuated, the pressure differential may be increased between the covered crucible and the evacuated chamber. The pressure differential may be increased by the addition of inert gas into the covered crucible to a pressure higher than in the sealed vessel. The pressure increase may be brief and occur only at the time of draining the melted material to encourage filling of the chamber and draining substantially all of the melted material.

In the long term, over the space of around 30 seconds to a minute, certain crucible and/or mold spaces may leak. Most, if not all, benefits described herein might nevertheless be obtained and less concern may exist over maintaining sealed engagements and over the complexities they add to remote operability. The central part of a transient casting operation, when melted material drains from a crucible into an evacuated mold, may be completed in less than a second. The small amount of pressure leakage that might occur from a covered, but not sealed, crucible and/or a mold may be negligible.

Complete draining may depend on the evacuated volume (reservoir, chamber, etc.) below the crucible being sufficient to receive the melted material. If a chamber does not fill from near its bottom, then the crucible might not drain completely when the amount of melted material is sufficiently large. Hence, the importance of proper mold temperature for not too quick of solidification becomes apparent.

Further, the solidified material may include a cylindrical shape that exhibits an aspect ratio of at least about 30. The mold may include an inner cone and a complementary outer cup, the inner cone contacting the outer cup, and the removing of the solidified material may include separating the inner cone from the outer cup. Such a removing process may reduce generation of high-level wastes in comparison to techniques involving single-use quartz molds.

According to a still further aspect of the invention, a casting method includes charging a crucible with a solid material and covering the crucible, the material exhibiting a minimum temperature of melting, evacuating the crucible to a vacuum less than 1 atm absolute, and pressurizing the evacuated crucible with an inert gas to a pressure greater than the vacuum. A reusable mold is heated to greater than 100° C. but less than the minimum temperature and the crucible is heated to greater than the minimum temperature, completely melting the material. The method includes evacuating a plurality of chambers of the mold to less than the pressure of the pressurized crucible through vacuum taps into the chambers. A top end of the individual chambers is open to and positioned below a closed bottom orifice of the crucible, the vacuum taps are below the top end of the individual chambers, and a difference of at least 1 atm exists between the pressurized crucible and the evacuated chambers. The method includes opening the bottom orifice of the pressurized crucible, draining substantially all of the melted material from the pressurized crucible, distributing the drained material among the evacuated chambers through the top ends into the evacuated chambers, solidifying the material in the chambers, and removing the solidified material from the chambers without damaging the chambers. The solidified material from individual chambers includes a cylindrical shape that exhibits an aspect ratio of at least about 30.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A casting method comprising:

charging a crucible with a solid material exhibiting a minimum temperature of melting;

heating a reusable mold comprising a plurality of mold chambers symmetrically distributed around and angularly offset from a central axis of the reusable mold, and having a first portion and defined by an outer wall of an inner member having a cone shape and a remaining portion of the mold chamber being defined by an inner wall of a complementary outer member having a cup shape complementary to the cone shape of the inner member and having the inner member received therein to a temperature greater than 100 ° C. but less than the minimum temperature of melting with an induction heating coil positioned around an outer wall of the complementary outer member and having a conical shape complementary to the outer wall of the complementary outer member;

heating the crucible to greater than the minimum temperature of melting and melting the solid material with a second induction heating coil separate from the induction heating coil positioned around the reusable mold;

evacuating the plurality of mold chambers to a pressure of less than 1 atm absolute through at least one vacuum tap located below a top end of the plurality of mold chambers positioned below a closed bottom orifice of the crucible;

opening the closed bottom orifice of the crucible, draining the melted material through the top end into the evacuated plurality of mold chambers by flowing the melted material over a peak of the cone-shaped inner member and into each mold chamber of the plurality of mold chambers, and solidifying the melted material in the at least one mold chamber; and removing the solidified material from the plurality of mold chambers by separating the inner member from the complementary outer member of the reusable mold.

2. The method of claim 1, further comprising:

covering the crucible before heating the crucible;

evacuating the covered crucible to a vacuum less than 1 atm absolute; and pressurizing the evacuated, covered crucible with an inert gas to a pressure greater than the vacuum.

3. The method of claim 2, further comprising employing argon as the inert gas.

4. The method of claim 1, further comprising:

evacuating a sealed vessel surrounding the crucible and the mold to a vacuum less than 1 atm absolute; and pressurizing the sealed vessel with an inert gas to a pressure greater than the vacuum within the sealed vessel.

5. The method of claim 4, further comprising locating the sealed vessel in an isolated chamber and performing the method using manipulations remotely controlled from outside the isolated chamber.

6. The method of claim 1, wherein solidifying the melted material comprises solidifying a melted, recycled nuclear fuel alloy.

7. The method of claim 1, further comprising generating electromagnetic stirring forces in melted material in the crucible using the second induction heating coil.

8. The method of claim 1, further comprising initiating a pressure difference of at least 1 atm between the crucible and the plurality of evacuated mold chambers prior to opening the closed bottom orifice.

9. The method of claim 1, wherein draining the melted material comprises draining substantially all of the melted material from the crucible.

10. The method of claim 1, wherein solidifying the melted material comprises draining the melted material into a removable sheath disposed within and extending along at least one mold chamber of the plurality of mold chambers.

11. The method of claim 1, wherein solidifying the melted material comprises forming a cylindrical shape of solidified material that exhibits an aspect ratio of at least about 30.

12. The method of claim 1, further comprising performing the method in the absence of any active cooling.

13. A casting method comprising:

charging a crucible with a solid material exhibiting a minimum temperature of melting;

evacuating the crucible to a vacuum less than 1 atm absolute;

pressurizing the evacuated crucible with an inert gas to a pressure greater than the vacuum;

heating a reusable mold comprising a plurality of mold chambers symmetrically distributed around and angularly offset from a central axis of the reusable mold, and having a first portion and defined by an outer wall of an inner member having a cone shape and a remaining portion of the mold chamber being defined by an inner wall of a complementary outer member having a cup shape complementary to the cone shape of the inner member and having the inner member received therein to greater than 100 ° C. but less than the minimum temperature of melting with an induction heating coil positioned around an outer wall of the complementary outer member and having a shape complementary to the outer wall of the complementary outer member;

heating the crucible to greater than the minimum temperature and completely melting the material with a second induction heating coil separate from the induction heating coil positioned around the reusable mold;

evacuating a plurality of chambers of the mold positioned below a closed bottom orifice of the crucible to a pressure of at least 1 atm less than the pressure of the pressurized crucible through vacuum taps formed in the mold at a base of the plurality of chambers; and opening the bottom orifice of the pressurized crucible, draining substantially all of the melted material from the pressurized crucible, simultaneously distributing the drained melted material among the plurality of evacuated chambers through the top ends thereof into the plurality of evacuated chambers by flowing the melted material over a peak of the cone-shaped inner member and into each mold chamber of the plurality of mold chambers, solidifying the melted material in the plurality of chambers, and removing the solidified material comprising separating the inner member from the complementary outer member.

14. The method of claim 13, further comprising:

evacuating a sealed vessel surrounding the crucible and the mold to a vacuum less than 1 atm absolute; and pressurizing the sealed vessel with an inert gas to a pressure greater than the vacuum.

15. The method of claim 14, further comprising locating the sealed vessel in an isolated chamber, performing the method using manipulations remotely controlled from outside the isolated chamber, and wherein solidifying the melted material comprises solidifying a recycled nuclear fuel alloy.

16. The method of claim 13, further comprising generating electromagnetic stirring forces in melted material in the crucible using the second induction heating coil.

* * * * *